US009868605B2

(12) United States Patent
Bishop

(10) Patent No.: US 9,868,605 B2
(45) Date of Patent: Jan. 16, 2018

(54) GEOTEXTILE ROLLING APPARATUS

(71) Applicant: Andrew L. Bishop, Ulster, PA (US)

(72) Inventor: Andrew L. Bishop, Ulster, PA (US)

( * ) Notice: Subject to any disclaimer, the term of this patent is extended or adjusted under 35 U.S.C. 154(b) by 519 days.

(21) Appl. No.: 14/620,501

(22) Filed: Feb. 12, 2015

(65) Prior Publication Data

US 2015/0225195 A1 Aug. 13, 2015

Related U.S. Application Data

(60) Provisional application No. 61/938,890, filed on Feb. 12, 2014.

(51) Int. Cl.

| | |
|---|---|
| ***B65H 18/20*** | (2006.01) |
| ***B65H 23/00*** | (2006.01) |
| ***B65H 18/02*** | (2006.01) |
| ***B65H 18/22*** | (2006.01) |

(52) U.S. Cl.
CPC ... *B65H 18/22* (2013.01); *B65H 2301/41429* (2013.01); *B65H 2701/1922* (2013.01)

(58) Field of Classification Search
CPC ..... B65H 18/22; B65H 18/20; B65H 23/00; B65H 18/023; B65H 2701/1922; B65H 18/02; B65H 18/10
USPC ..... 242/535, 541.1, 541.2, 541.3
See application file for complete search history.

(56) References Cited

U.S. PATENT DOCUMENTS

| | | | | |
|---|---|---|---|---|
| 1,274,231 A | | 7/1918 | Bairs | |
| 2,462,315 A | | 2/1949 | Fuqua | |
| 3,387,437 A | | 6/1968 | Owen | |
| 3,481,556 A | | 12/1969 | McDonnell | |
| 3,687,392 A | | 8/1972 | Parry | |
| 4,084,763 A | | 4/1978 | Zamboni | |
| 4,090,540 A | | 5/1978 | Smith et al. | |
| 4,114,530 A | * | 9/1978 | Miller | B30B 9/3082 100/87 |
| 4,354,556 A | | 10/1982 | Evans | |
| 4,542,859 A | * | 9/1985 | Gerstenberger | B65B 63/024 242/535.1 |

(Continued)

FOREIGN PATENT DOCUMENTS

| | | |
|---|---|---|
| JP | 07237823 A | 9/1995 |
| JP | 07237824 A | 9/1995 |

(Continued)

*Primary Examiner* — William A Rivera
*Assistant Examiner* — Mark K Buse
(74) *Attorney, Agent, or Firm* — Brown & Michaels, PC

(57) ABSTRACT

A geotextile rolling and collecting apparatus includes a mounting plate, a pair of outer lower forks arranged laterally, a pair of outer upper forks, at least one linear actuator, at least one lower feed drum, at least one upper feed drum, and at least one first drive motor. The first drive motor is coupled to rotate the lower feed drum on a first horizontal axis and to counter-rotate the upper feed drum on a second horizontal axis. With the geotextile rolling and collecting apparatus in a collecting position, a geotextile liner grasped between the feed drums is fed by counter-rotation of the upper feed drum and the lower feed drum into a collecting volume behind the upper feed drum and the lower feed drum and between the upper forks and the lower forks to form at least one geotextile liner roll in the collecting volume.

19 Claims, 13 Drawing Sheets

(56) References Cited

U.S. PATENT DOCUMENTS

| | | | | | |
|---|---|---|---|---|---|
| 4,765,554 | A * | 8/1988 | Tuffal | B65H 27/00 | 242/535.1 |
| 5,011,093 | A * | 4/1991 | Mayer | B65H 19/2276 | 242/527.5 |
| 5,129,462 | A | 7/1992 | Mail | | |
| 5,304,014 | A | 4/1994 | Slutz | | |
| 5,305,963 | A * | 4/1994 | Harvey, III | B65B 63/024 | 100/40 |
| 5,425,512 | A * | 6/1995 | Bichot | B65B 63/024 | 242/541.2 |
| 5,895,008 | A * | 4/1999 | Sanders | B65H 19/2276 | 242/541.2 |
| 5,971,311 | A * | 10/1999 | Fujii | G03B 17/30 | 242/348.4 |
| 6,109,560 | A * | 8/2000 | Siegel | B65B 63/024 | 100/88 |
| 6,123,284 | A * | 9/2000 | Bichot | B65B 63/024 | 242/535.1 |
| 6,299,094 | B1 | 10/2001 | James, Jr. | | |
| 7,100,862 | B2 * | 9/2006 | Skarzenski | B30B 9/3082 | 100/87 |
| 8,388,764 | B2 | 3/2013 | Jonsson | | |
| 8,464,801 | B2 | 6/2013 | Bearden | | |
| 2003/0150953 | A1 | 8/2003 | Gent | | |
| 2010/0314482 | A1 | 12/2010 | Merkt | | |
| 2012/0031814 | A1 | 2/2012 | Hinkel | | |
| 2013/0074670 | A1 | 3/2013 | Albin et al. | | |
| 2013/0189057 | A1 | 7/2013 | Motz et al. | | |
| 2013/0240659 | A1 | 9/2013 | Akpan | | |
| 2013/0330156 | A1 | 12/2013 | Motz et al. | | |
| 2014/0326821 | A1 * | 11/2014 | Bishop | B26D 1/185 | 242/533.8 |
| 2015/0166286 | A1 * | 6/2015 | Morris | B09B 3/00 | 242/533.8 |
| 2015/0166287 | A1 * | 6/2015 | Van Gurp | B65H 18/22 | 242/535.4 |
| 2015/0225195 | A1 | 8/2015 | Bishop | | |

FOREIGN PATENT DOCUMENTS

| | | | |
|---|---|---|---|
| JP | 10192474 | A | 7/1998 |
| JP | 2000008314 | A | 1/2000 |
| JP | 3575834 | B2 | 10/2004 |

* cited by examiner

GEOTEXTILE ROLLING APPARATUS

REFERENCE TO RELATED APPLICATIONS

This application claims one or more inventions which were disclosed in Provisional Application No. 61/938,890, filed Feb. 12, 2014, entitled "Geotextile Rolling Apparatus". The benefit under 35 USC §119(e) of the United States provisional application is hereby claimed, and the aforementioned application is hereby incorporated herein by reference.

BACKGROUND OF THE INVENTION

Field of the Invention

The invention pertains to the field of landscape fabric recovery. More particularly, the invention pertains to apparatus and methods for rolling and removing geotextile liners used as ground covers.

Description of Related Art

Drill pad site remediation and other geotextile liner removal operations are performed to collect used geotextile liners in a space-efficient manner to minimize transport costs and storage requirements, whether permanently in a landfill or temporarily prior to final disposition. Ideally, the geotextile liner material is ultimately transferred to a recycling facility, where the material can be either repurposed or the polymers which form the geotextile liners can be harvested and converted into plastic raw materials or articles of manufacture.

Unfortunately, conventional methods of collecting used geotextile liners are not conducive to recycling efforts. Dirt, rocks, and other debris contaminate bales of used geotextile liner material during collection or are introduced into loose shreds of the geotextile liners stored in transportable containers and interfere with and complicate recycling processes. Further, regardless of the manner of storage and transport of compressed bales of geotextile liners or loose shreds of geotextile liners in containers, the non-uniform size and shape of the geotextile shreds makes handling of the recovered geotextile liners at recycling facilities unwieldy, complicated, and expensive. Recyclers demand that geotextile liners be delivered in a relatively clean state, free of foreign matter, and in a uniform and consistent package that can, for example, be directly fed into shredding machines as a first step in recycling. Current collection methods do not meet these criteria.

Geotextile liners include a wide range of sheet or mat materials used in various applications related to oil and gas exploration, construction, landscaping, and other industries. These geotextile liners may be porous or non-porous, natural or synthetic, and include one layer or more than one layer depending on their intended use. Most notably, the oil and gas exploration industry makes extensive use of geotextile liners in various aspects of drilling operations. Environmental concerns related to spillage of drilling fluids, hydrofracking additives, and other potentially harmful contaminants dictate that drill pads be constructed with non-porous, heavy-gauge, multi-ply geotextile liners as isolation layers with a heavy gauge plastic sheet ply between two separable felt plies that inhibit punctures from rocks or other objects above and below the geotextile liners.

Isolation layers are formed from continuous lengths of geotextile material that are unrolled from bulk rolls in overlapping strips covering an area to be protected. The overlaps are then formed into water-tight seams by various methods including heat sealing and welding the sheets of geotextile liner together to create a single monolithic layer. A typical geotextile liner may cover an area of 200,000 to 300,000 square feet after the individual sheets of geotextile liner are joined at their overlaps. Gravel, sand, or soil distributed above the now-isolated landscape provides a surface for vehicles and other machinery to move on, while chemicals potentially spilled in the area are prevented from leeching into ground water or contaminating native soils under the geotextile liners.

In other applications, geotextiles are used to form a water-tight layer at the bottom of excavations to create artificial ponds for storage of fresh water used in hydrofracking. Artificial ponds are created for storing contaminated water and allowing natural evaporative mechanisms to return at least a part of the water to the environment without a need for treatment. Similarly, ditches are lined to channel contaminated fluids without contaminating underlying soils or aquifers. In still further applications, geotextiles are used to create temporary road beds, to protect embankments, on protective berms for soil erosion control, and for other soil management purposes.

Many jurisdictions require that oil and gas drilling sites, whether productive or not, be returned to a natural state at the completion of drilling operations. These requirements also apply to temporary ponds and other well-related structures that would potentially pose a future environmental hazard or that may be visually unappealing.

Conventional remediation practice allows geotextile liners to be buried in place. For example, pond liners are folded into the bottom of the pond excavation they line and are buried with soil previously removed from the same excavation. However, burying geotextile liners in place is not universally possible. In some cases burying geotextile liners is environmentally undesirable, because the geotextile liners may become highly contaminated with drilling fluids and other harmful substances that the geotextile liners are designed to block from seeping into underlying soils.

As a result, current best practice dictates complete removal of geotextile liners from well pad sites when drilling operations are completed. Removal of geotextile liners from a well pad site is complicated by the seamed connections that are created between sheets during the installation process. Geotextile liners are applied directly to the ground in long sheets taken from a construction vehicle holding a bulk spool of material. The finished liner after seaming may cover an area of 200,000 to 300,000 square feet, making the geotextile liner unwieldy to handle during removal and difficult to arrange in compact packages for transport to landfills or recycling facilities.

Removal of the geotextile liners therefore requires that the monolithic sheet be cut into smaller, manageable sections prior to or during collection. One conventional method of cutting geotextile liners is to use a "pizza cutter" cutting wheel designed for scoring asphalt surfaces. The cutting wheel is attached to the bucket of a front end loader or other piece of heavy construction equipment that moves across the geotextile liner and forces the cutting wheel through the geotextile liner and into the ground below. This method is not efficient, however, as soft soils under the geotextile liners allow the geotextile liners to simply sink into the earth under the cutting wheel rather than being cut by the cutting wheel. As a result, cuts are often completed manually using small knives such as gypsum cutters. In some cases, this method is completely abandoned, and the geotextile liners are torn into random shreds using a claw arm of a heavy construction vehicle.

Disposal of the geotextile liners is also difficult. In some instances, the recovered geotextile liner shreds are packed into roll-off containers or mobile garbage bins and transported to landfills. In other cases, the recovered geotextile liner shreds are placed into bailers, similar to car crushers used in scrap metal recovery, and formed into blocks. In either case, the recovered geotextile liner shreds are not only unwieldy to handle and space consumptive in landfills but also often unsuitable for recycling, because the recovery process introduces rocks, soil, and other debris into the recovered material that may complicate or preclude the recycling of the high-value polymers used to make geotextile liners.

SUMMARY OF THE INVENTION

A geotextile rolling and collecting apparatus includes a mounting plate, a pair of outer lower forks arranged laterally, a pair of outer upper forks, at least one linear actuator, at least one lower feed drum, at least one upper feed drum, and at least one first drive motor. Each outer lower fork is substantially L-shaped and includes a vertical section extending vertically upward from a horizontal section and attached to the front side of the mounting plate. Each outer upper fork is substantially L-shaped and has a first end pivotally attached to the vertical section of one of the pair of outer lower forks. The linear actuator is coupled to rotate the outer upper forks with respect to the outer lower forks between a collecting position and an open position. The lower feed drum is mounted on a horizontal axis between horizontal sections of the pair of outer lower forks. The upper feed drum is mounted on a second horizontal axis between the second ends of the pair of outer upper forks. The first drive motor is coupled to rotate the lower feed drum on the first horizontal axis and to counter-rotate the upper feed drum on the second horizontal axis. With the geotextile rolling and collecting apparatus in the collecting position, a geotextile liner grasped between the upper feed drum and the lower feed drum is fed by counter-rotation of the upper feed drum and the lower feed drum into a collecting volume behind the upper feed drum and the lower feed drum and between the upper forks and the lower forks to form at least one geotextile liner roll in the collecting volume.

A method of collecting a geotextile liner located on a ground surface as at least one geotextile liner roll includes placing a leading edge of the geotextile liner between at least one upper feed drum and at least one lower feed drum of a geotextile rolling and collecting apparatus in a collecting position. The method also includes feeding the geotextile liner grasped between the upper feed drum and the lower feed drum by counter-rotation of the upper feed drum and the lower feed drum into a collecting volume behind the upper feed drum and the lower feed drum and between the upper forks and the lower forks. The method further includes rotating the geotextile liner in a predetermined direction within the collecting volume as the geotextile liner is fed to the collecting volume to form the geotextile liner roll in the collecting volume.

DETAILED DESCRIPTION OF THE INVENTION

A geotextile rolling and collection apparatus forms compact rolls of recovered geotextile liner that has been cut into long strips of relatively uniform width. The rolls of recovered geotextile liner may be easily transferred directly from the geotextile rolling and collection apparatus to, for example, a flatbed truck for transportation. Alternatively, the rolls of recovered geotextile liner may be lifted and moved using a front end loader lance attachment similar to those used for moving large round bales of hay. Thus, rolls of recovered geotextile liner may be easily transferred to and from trucks and between storage areas and recycling process equipment at recycling facilities.

Rolls of recovered geotextile liner may be formed without using a central spindle, core, axle, or other element at the center of the roll of recovered geotextile liner. Therefore rolls of recovered geotextile liner may be directly fed into shredding equipment prior to further processing during recycling. Alternatively, a core may be inserted into the center of the roll of recovered geotextile liner. Using a core allows the roll of recovered geotextile to be unwound and fed into process machinery in a continuous sheet for shredding, washing, or other processing.

Figure 1:
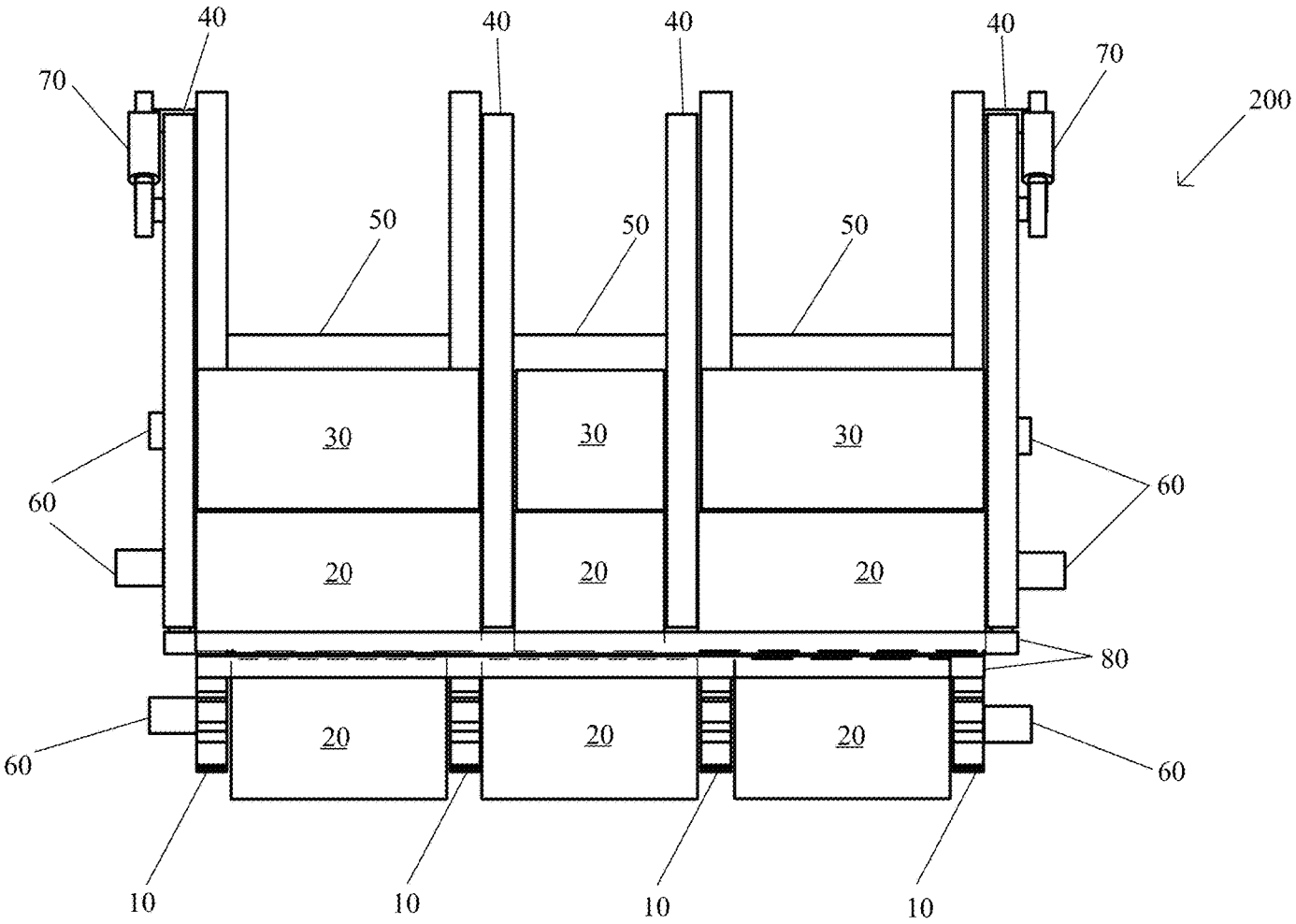
FIG. 1 shows a front view of a geotextile rolling and collection apparatus.
Figure 2:
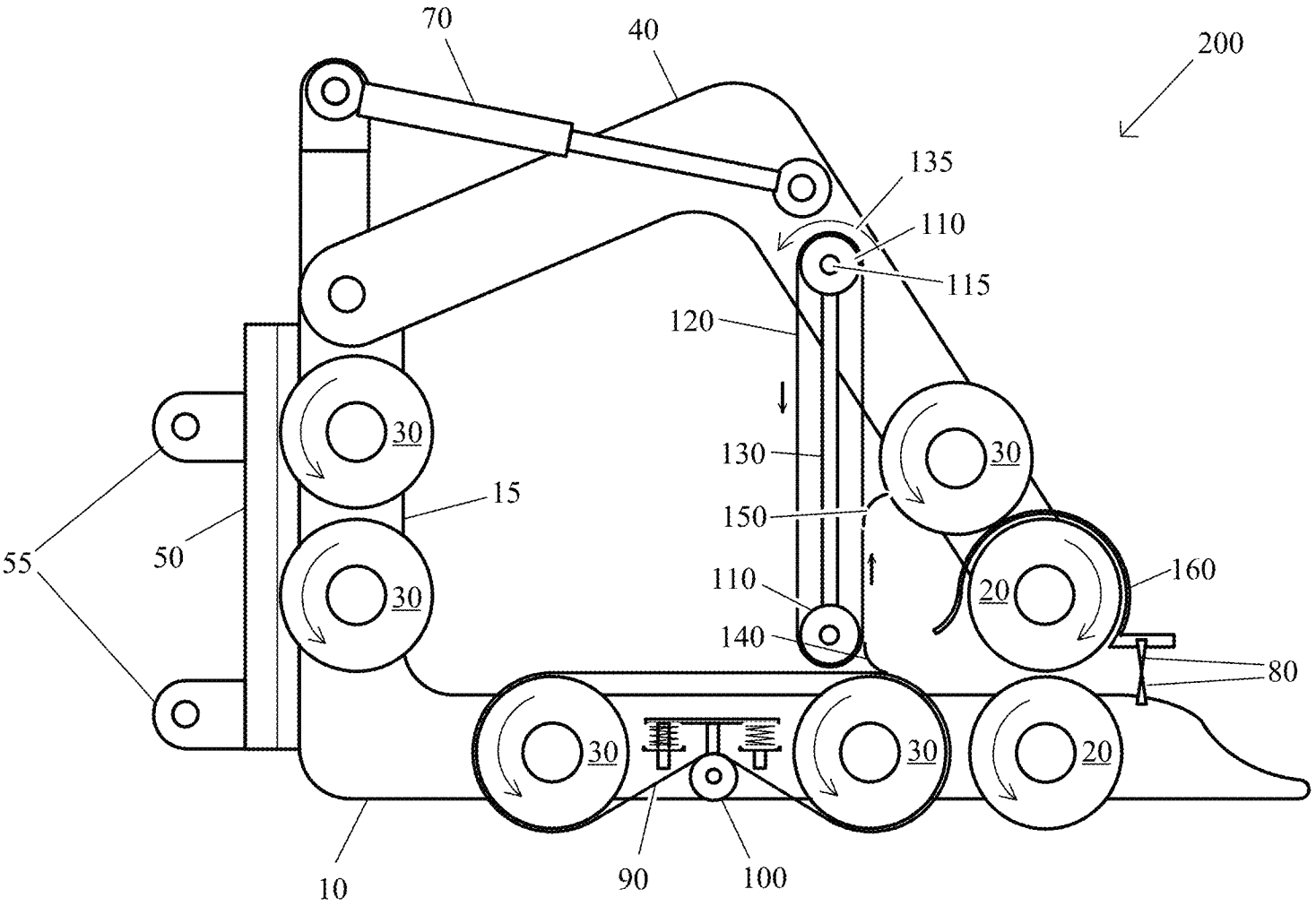
FIG. 2 shows a side view of the geotextile rolling and collection apparatus of FIG. 1.

Referring to FIG. 1 and FIG. 2, a geotextile rolling and collection apparatus 200 includes a universal skid steer adapter as a mounting plate 50, and provides mounts 55 to standard fitments found on a wide range of carriage equipment. While the term "skid steer" is used herein throughout, one skilled in the art will appreciate that any prime mover equipped with appropriate hydraulic interfaces, and lifting arms capable of moving upwardly and downwardly, as well as changing the pitch angle of an apparatus attached to the lifting arms, provides a suitable carriage system for the geotextile rolling and collection apparatus 200. For example, such equipment may include, but is not limited to, any carriage or prime mover capable of adaptation to a bucket loader, a brush claw, or other hydraulically driven movable attachments.

FIG. 1 and FIG. 2 show four lower forks 10 attached to a mounting plate 50, and extending forwardly therefrom. As show in FIG. 2, the four lower forks 10 also extend vertically upward at the rear of the geotextile rolling apparatus along the mounting plate 50. While four equally spaced lower forks 10 are shown in FIG. 1, this configuration should not be considered limiting of the apparatus, as any number of lower forks 10 may be employed, depending on the desired width and final weight of the rolls to be collected with the geotextile rolling and collection apparatus 200.

Figure 10:
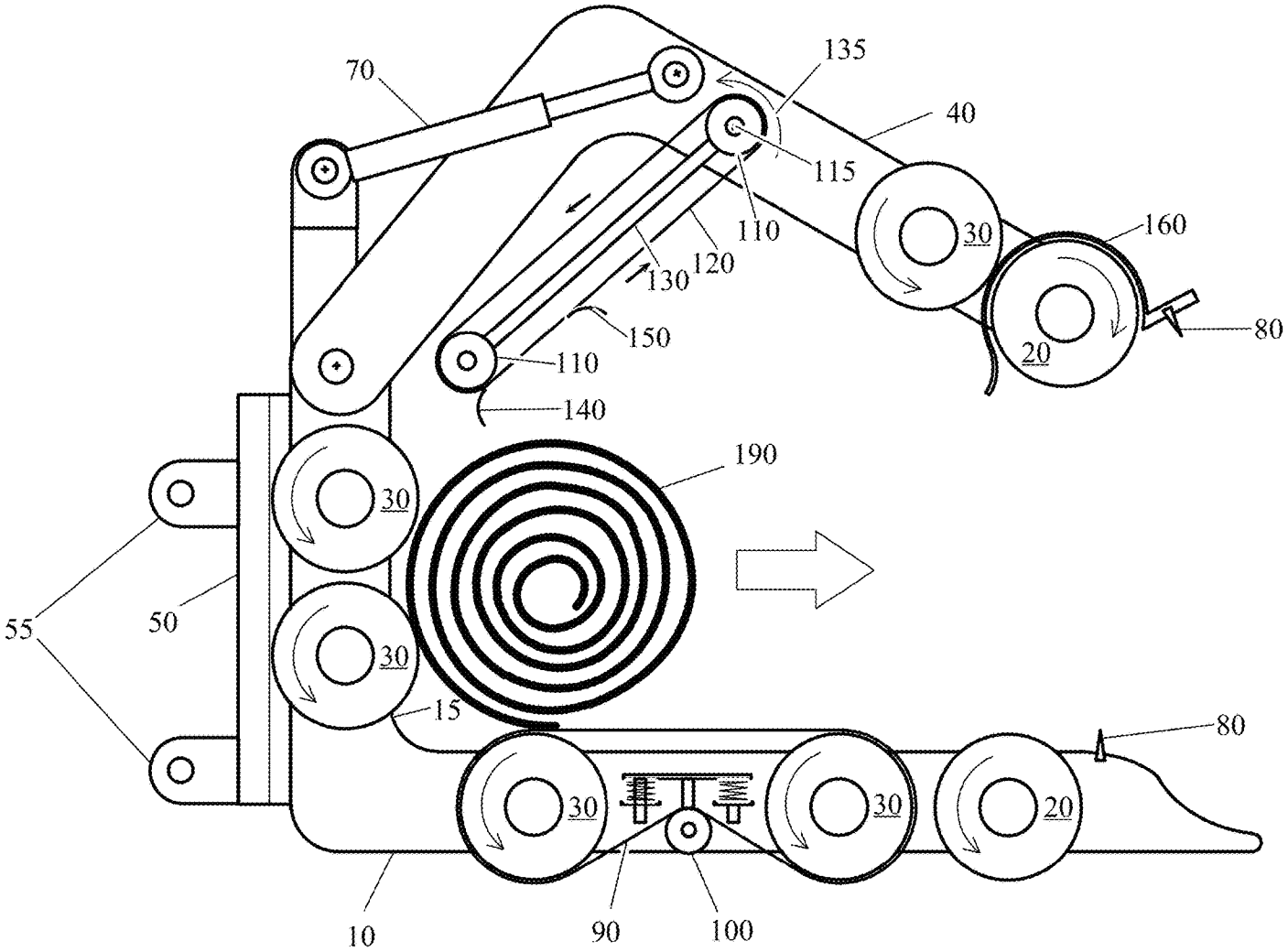
FIG. 10 shows a side view of the geotextile rolling and collection apparatus of FIG. 1, having accumulated a complete geotextile roll, in an open position, allowing removal of the geotextile roll.

Upper forks 40 are movably attached to the lower forks 10, so that the upper forks 40 may be lowered to roll geotextile material or, as shown in FIG. 10, raised to allow a completed geotextile roll to be removed from the geotextile rolling and collection apparatus 200, for example, by tilting the geotextile rolling and collection apparatus 200 forward such that the geotextile roll can roll forward and onto a storage stack or a transport vehicle.

While the upper forks 40 and lower forks 10 have been depicted as substantially "L" shaped elements, other geometries are also possible, including but not limited to, semicircular or arcuate elements forming a "clam shell" profile such that the upper forks 40 and lower forks 10 define an internal space when the upper forks 40 and lower forks 10 are in a collecting position with a first end of the upper forks 40 brought to a position near a first end of the lower forks 10. Thus, the upper forks 40 and lower forks 10 cradle and confine the geotextile roll, as the geotextile liner material is collected in the internal space defined by the upper forks 40 and lower forks 10.

A series of rotating feed drums 20 is mounted between adjacent lower forks 10 at the first end of the lower forks 10, with the surface of each feed drum 20 extending above the lower forks 10. As shown in FIG. 1, each of the feed drums 20 of the lower forks 10 may be independently driven by hydraulic motors 60. The rotational speed of each feed drum 20 of the lower forks 10 is synchronized such that a sheet of geotextile liner being fed into the geotextile rolling and collection apparatus 200 is urged uniformly into the geotextile rolling and collection apparatus 200 across the width of the sheet.

In preferred embodiments, a differential speed controller is added to increase the rotational speed of feed drums 20 on one side of the geotextile rolling and collection apparatus 200, and decrease rotational speed of feed drums 20 at the other side of the geotextile rolling apparatus. Differentially changing the rotational speed of feed drums 20 across the width of the geotextile rolling apparatus in this manner adjusts tracking of the geotextile roll in the geotextile rolling and collection apparatus 200 such that the geotextile roll does not "wander" out of either side of the geotextile rolling and collection apparatus 200 as the geotextile roll forms. In other embodiments, the feed drums 20 may be connected to a common axle extending the entire width of the geotextile rolling and collection apparatus 200 and driven by a single hydraulic motor 60.

As shown in FIG. 1 and FIG. 2, feed drums 20 are similarly arranged, mounted, driven, and controlled between adjacent upper forks 40 at a first end of the upper forks 40. When the geotextile rolling and collection apparatus 200 is closed with the upper forks 40 and lower forks 10 in a collecting position, the feed drums 20 of the upper forks 40 and the feed drums 20 of the lower forks 10 clamp a geotextile liner between them with enough pressure to pull the geotextile liner into the geotextile rolling and collection apparatus 200. Gripping force may be adjusted by moving a linear actuator 70 to cause the feed drums 20 of the upper forks 40 to clamp down more forcefully against the opposing feed drums 20 of the lower forks 10.

In some embodiments, surface features are added to the feed drums 20 of the upper forks 40 and feed drums 20 of the lower forks 10 to increase the grip of the feed drums 20 on the geotextile liner between them. Surface features may include, but are not limited to, axial ribs or ridges that mate between the opposing feed drums 20, knurling, sets of bumps and corresponding mating dimples, and pyramidal points. Alternatively, or additionally, the feed drums 20 of the upper forks 40 and the feed drums 20 of the lower forks 10 may be coated with a layer of, for example, hard rubber or other material that has a high coefficient of friction relative to the geotextile liner to enhance gripping of the geotextile liner between opposing feed drums 20.

As shown in FIG. 1 and FIG. 2, opposing wiper blades 80 are provided in front of the feed drums 20 of the upper forks 40 and the feed drums 20 of the lower forks 10 to remove dirt, rocks, and other debris that may be present on the geotextile liner before the geotextile liner enters the geotextile rolling and collection apparatus. These wiper blades 80 may be formed, for example, of hard rubber that firmly contacts the upper and lower surfaces of the geotextile liner as the geotextile liner passes between the opposing wiper blades 80. The opposing wiper blades 80 are also preferably resilient so as not to damage the geotextile liner as the geotextile liner passes between the opposing wiper blades 80. In some embodiments, spray nozzles (not shown) located forward of the wiper blades 80 pre-wash the geotextile liner, which is then wiped clean and relatively dry through the action of the opposing wiper blades 80 as the geotextile liner passes between the opposing wiper blades 80. A prime mover carrying the geotextile rolling and collection apparatus may also carry or tow a water tank to provide water to the spray nozzles.

As shown in FIG. 2, one or more roller drums 30 are mounted between adjacent lower forks 10 at one or more positions between the feed drums 20 of the lower forks 10 and vertical elements 15 of the lower forks 10 attached to the mounting plate 50. As with the feed drums 20 of the lower forks 10, the roller drums 30 of the lower forks 10 may be individually driven by hydraulic motors 60, shown in FIG. 1, and also provided with differential speed control to improve tracking of the geotextile roll as the geotextile roll forms. In other embodiments, the roller drums 30 of the lower forks 10 are rotated uniformly as a group across the width of the geotextile rolling and collecting apparatus 200 on a single common axle.

In some embodiments, as shown in FIG. 2, the roller drums 30 of the lower forks 10 are optionally connected by a drive belt 90, upon which the geotextile roll forms as the drive belt 90 moves toward the vertical elements 15 of the lower forks 10 and between a plurality of roller drums 30 of the lower forks 10. A tensioner 100 may be provided to maintain contact between the drive belt 90 and roller drums 30 of the lower forks 10 and allow the drive belt 90 to flex as the weight of the geotextile roll increases during the rolling process.

Figure 11:
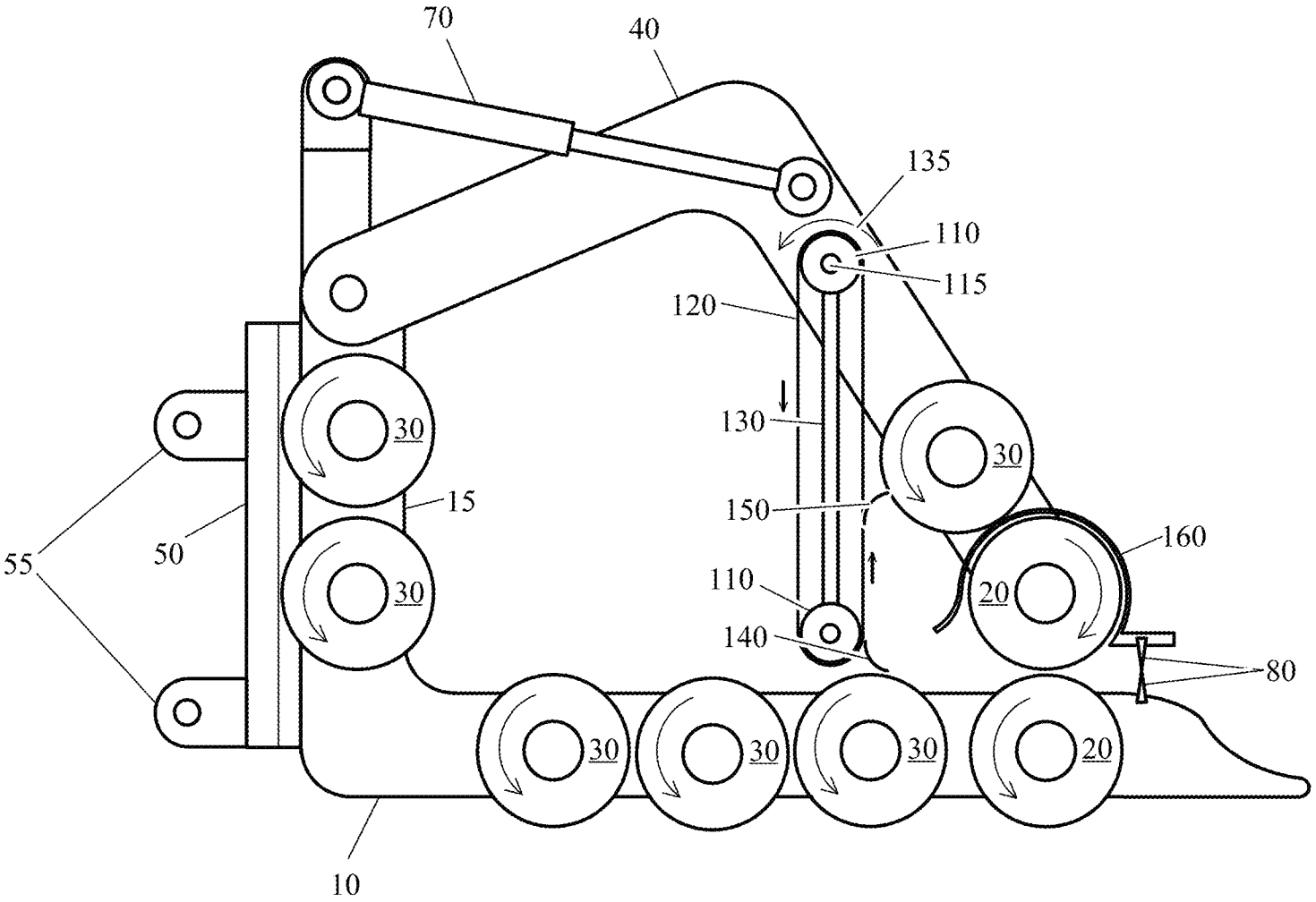
FIG. 11 shows a side view of a geotextile rolling and collection apparatus having multiple lower roller drums and no drive belt.

In other embodiments, as shown in FIG. 11, the roller drums 30 of the lower forks 10 are not connected by a drive belt, and the geotextile roll forms directly on or between one or more sets of roller drums 30 of the lower forks 10. As previously described herein, surface features may also be added to the drive belt 90, and/or roller drums 30 of the lower forks 10 to increase rolling friction with a geotextile liner during rolling and more reliably cause the geotextile liner to rotate as a geotextile roll forms and becomes heavier.

For the purposes of this description, "drive belt" 90 includes any of a variety of continuous loops spanning at least a part of the circumference of two or more roller drums 30. These continuous loops may include, but are not limited to, wide reinforced rubberized belts similar to those found in use as conveyor belts, one or more narrow reinforced belts similar to automotive engine belts, linked metal mesh belts, or one or more chains that mate with elements on a surface or axle of two or more roller drums 30. Drive belts 90 may include belts used solely for the purpose of transferring motive force to the geotextile liner being rolled but also include dual purpose drive belts 90 that additionally transfer motive force from one roller drum 30 to one or more other roller drums 30.

As shown in FIG. 2, a curl belt 120 is located between one or more adjacent sets of upper forks 40. For clarity, the curl belt 120 and the feed shroud 160 are not shown in FIG. 1. The curl belt 120 may be, for example, hydraulically driven and spans the curl belt drums 110 on a curl belt frame 130 that maintains tension on the curl belt 120. The curl belt 120 may be constructed in the same manner as the drive belts 90 described herein, and may also include surface features that similarly improve interaction of the curl belt 120 with the geotextile liner being rolled. In preferred embodiments, the curl belt 120 is also provided with a lower shroud 140 that is adjacent to the roller drums 30 of the lower forks 10 and/or drive belts 90.

At an upper extent of the upper forks 40, the curl belt frame 130 is mounted on a curl belt axle 115 between two upper forks and provided with a spring 135, which biases the curl belt frame 130 and the curl belt 120 to rotate about the curl belt axle 115 toward the front of the geotextile rolling and collecting apparatus.

Figure 3:
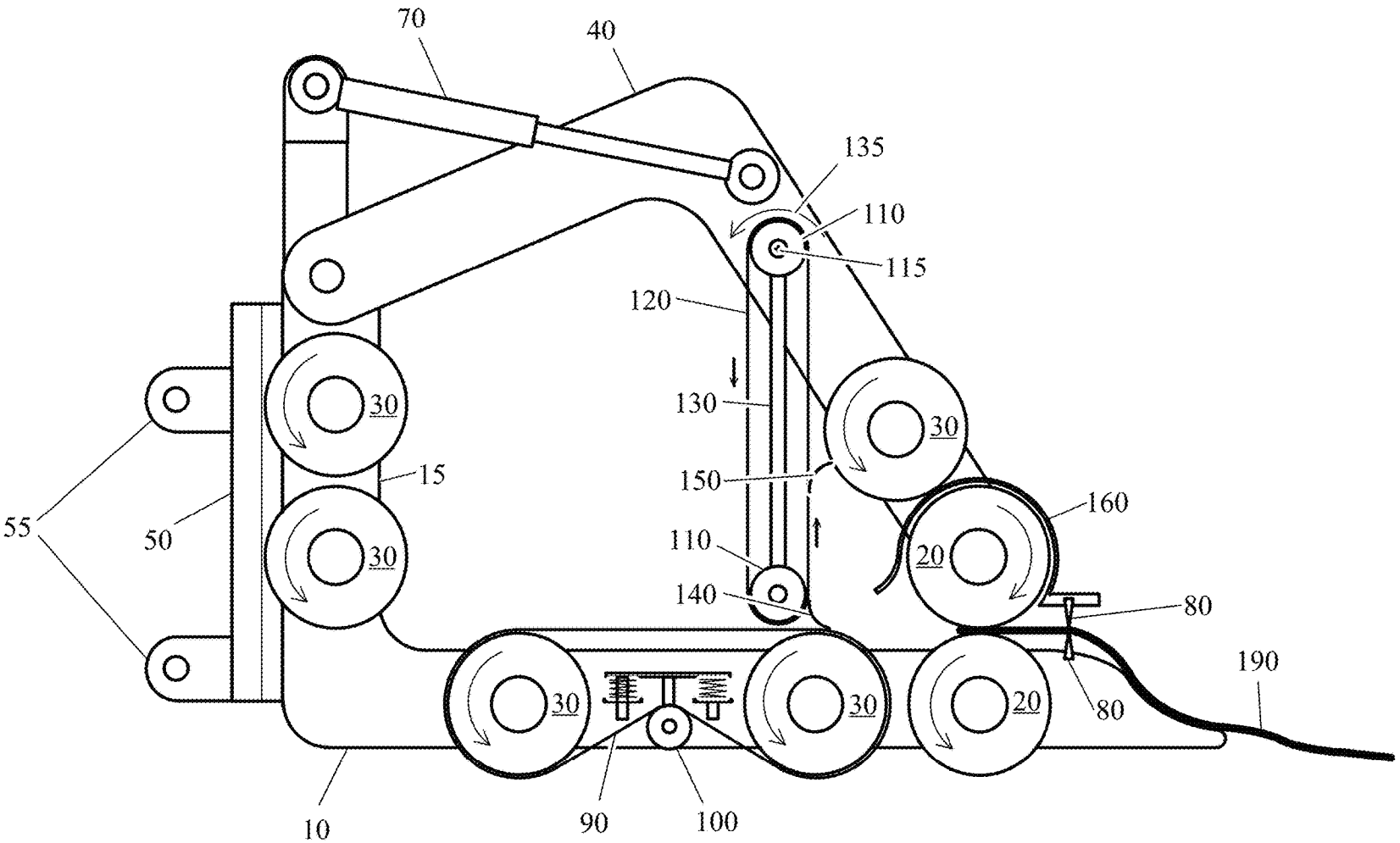
FIG. 3 shows a side view of the geotextile rolling and collection apparatus of FIG. 1 with a strip of geotextile initially positioned for rolling.
Figure 4:
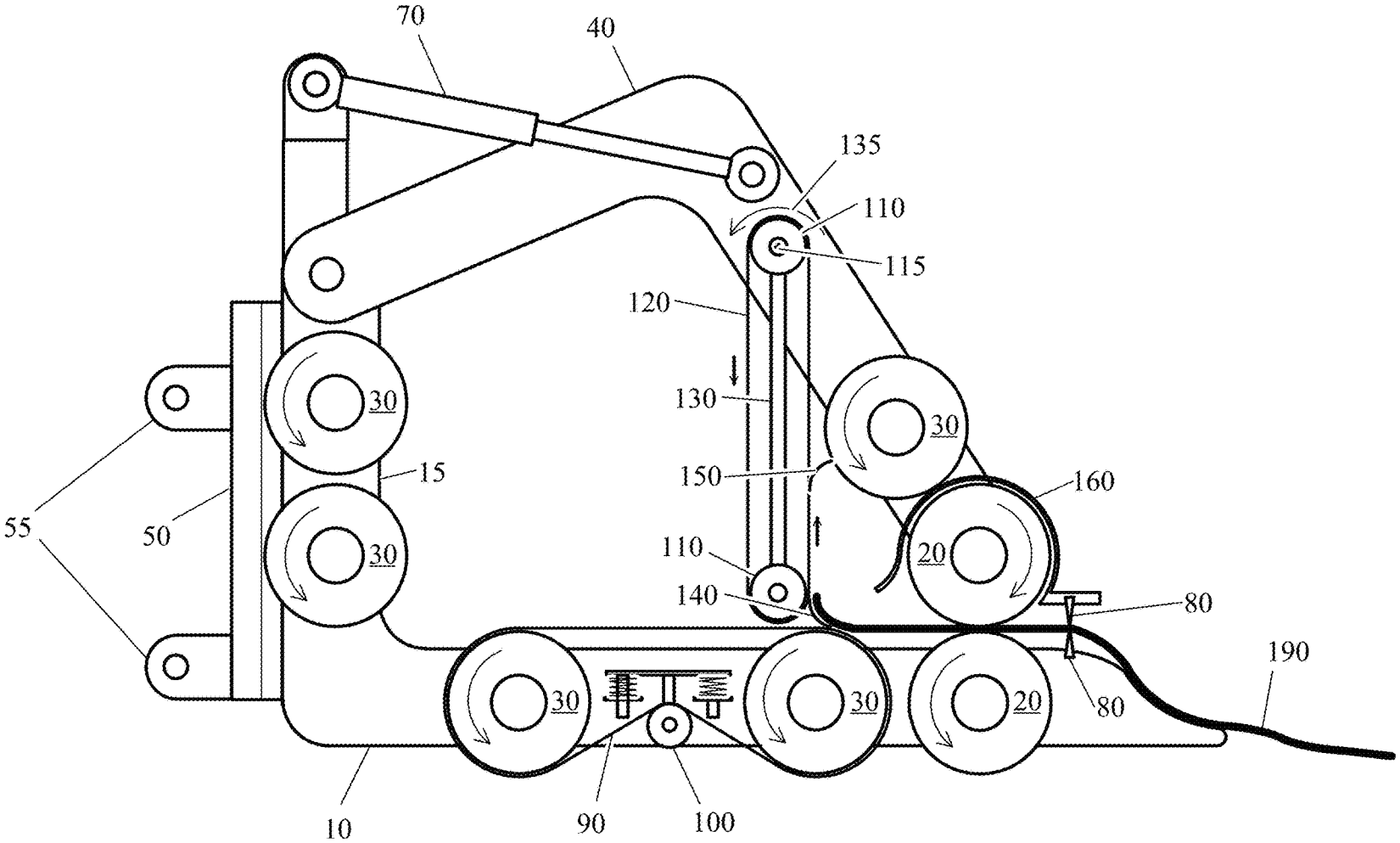
FIG. 4 shows a side view of the geotextile rolling and collection apparatus of FIG. 1 with a strip of geotextile feeding toward a curl belt.

FIG. 3 through FIG. 10 show the geotextile rolling and collecting apparatus in sequential stages of collecting a geotextile liner 190, forming a roll of the geotextile liner 190, and preparing to expel the roll of geotextile liner 190. As shown in FIG. 3, a leading edge of the geotextile liner 190 has passed between the wiper blades 80 and is being gripped and pulled in by the feed drums 20. As shown in FIG. 4, the leading edge of the strip of geotextile liner 190 being fed into the geotextile rolling and collecting apparatus is deflected upward and encouraged to curl and form the first winding of the geotextile roll when the strip of geotextile liner 190 encounters the curl belt 120.

Figure 5:
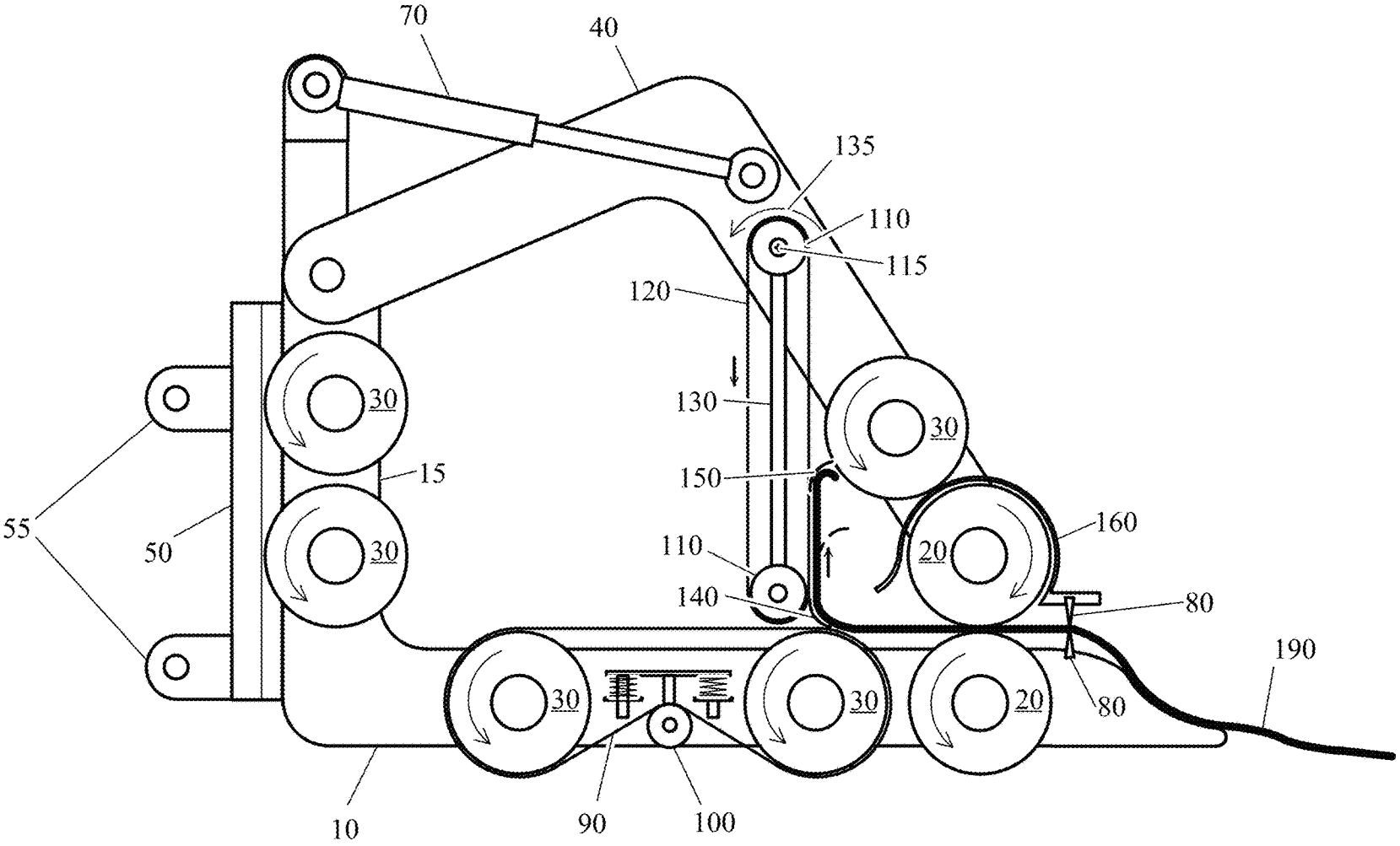
FIG. 5 shows a side view of the geotextile rolling and collection apparatus of FIG. 1 with a strip of geotextile feeding from a curl belt toward a roller drum.

As the geotextile liner 190 continues to be fed into the geotextile rolling apparatus, as shown in FIG. 5, the fed geotextile liner 190 tends to curl forward, as indicated by the dashed line in this figure, as the curl belt 120 diverts the geotextile liner 190 upwardly and away from the lower forks 10. In the event the geotextile liner 190 does not curl forward under its own weight, an upper shroud 150 is preferably provided to redirect the geotextile liner 190 to curl forward toward a roller drum 30 on the upper forks 40. The roller drums 30 of the upper forks 40 are located between adjacent upper forks 40 and may be driven to rotate by, for example, hydraulic motors 60. While only one set of roller drums 30 are shown on the upper forks 40, it will be understood that a plurality of roller drums 30 may be used with differential control and drive belts 90 as previously described herein with regard to the roller drums 30 of the lower forks 10.

Figure 6:
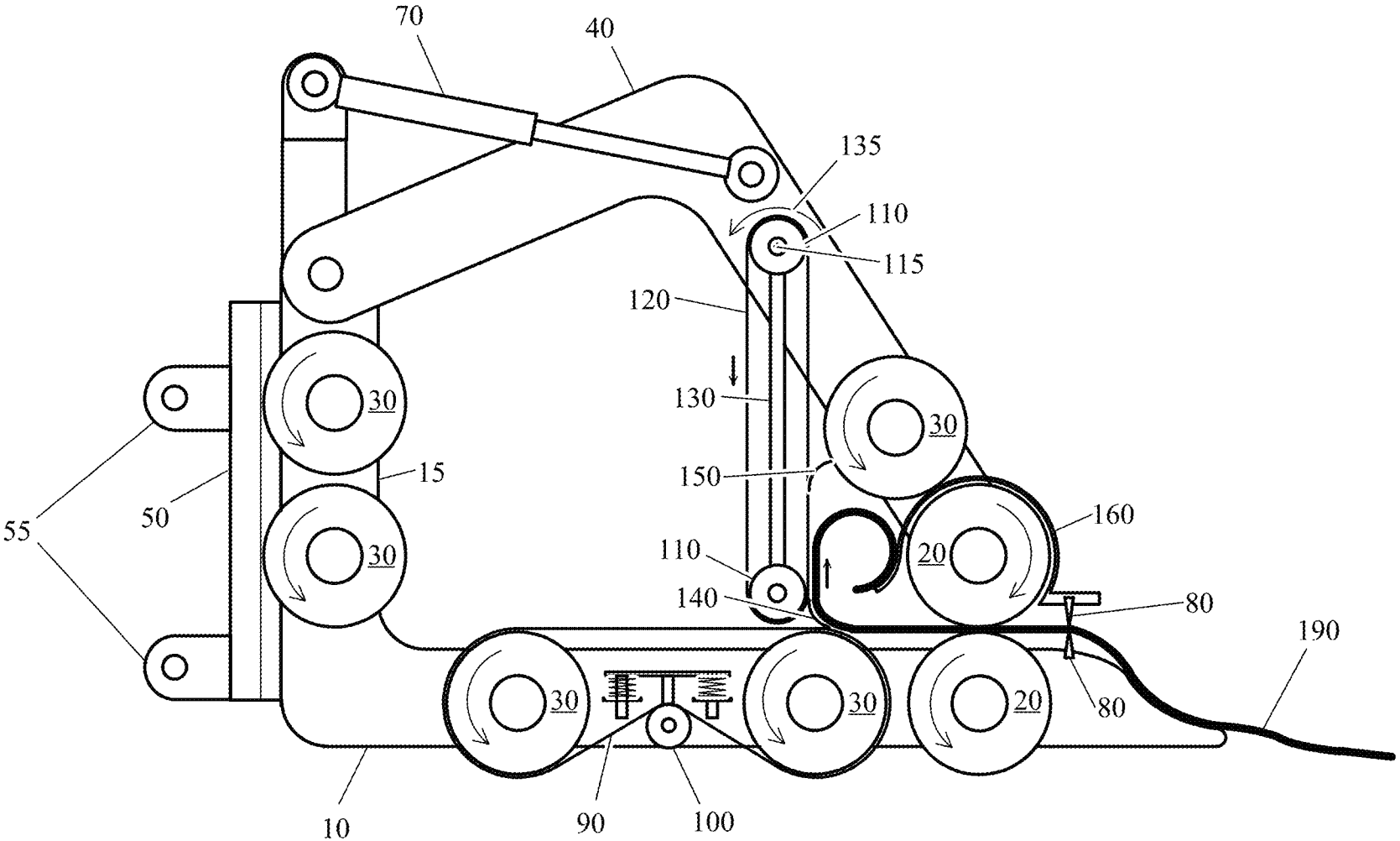
FIG. 6 shows a side view of the geotextile rolling and collection apparatus of FIG. 1 with a strip of geotextile feeding from a curl belt forming a first rotation of a geotextile roll.

Rotation of the roller drums 30 of the upper forks 40, in turn, redirects the geotextile liner 190 to roll downward toward the lower forks 10. In preferred embodiments, as shown in FIG. 6, a feed shroud 160 redirects the downward moving end of the geotextile liner 190 backwards toward the curl belt 120, forming the first wrap of the geotextile roll.

Figure 7:
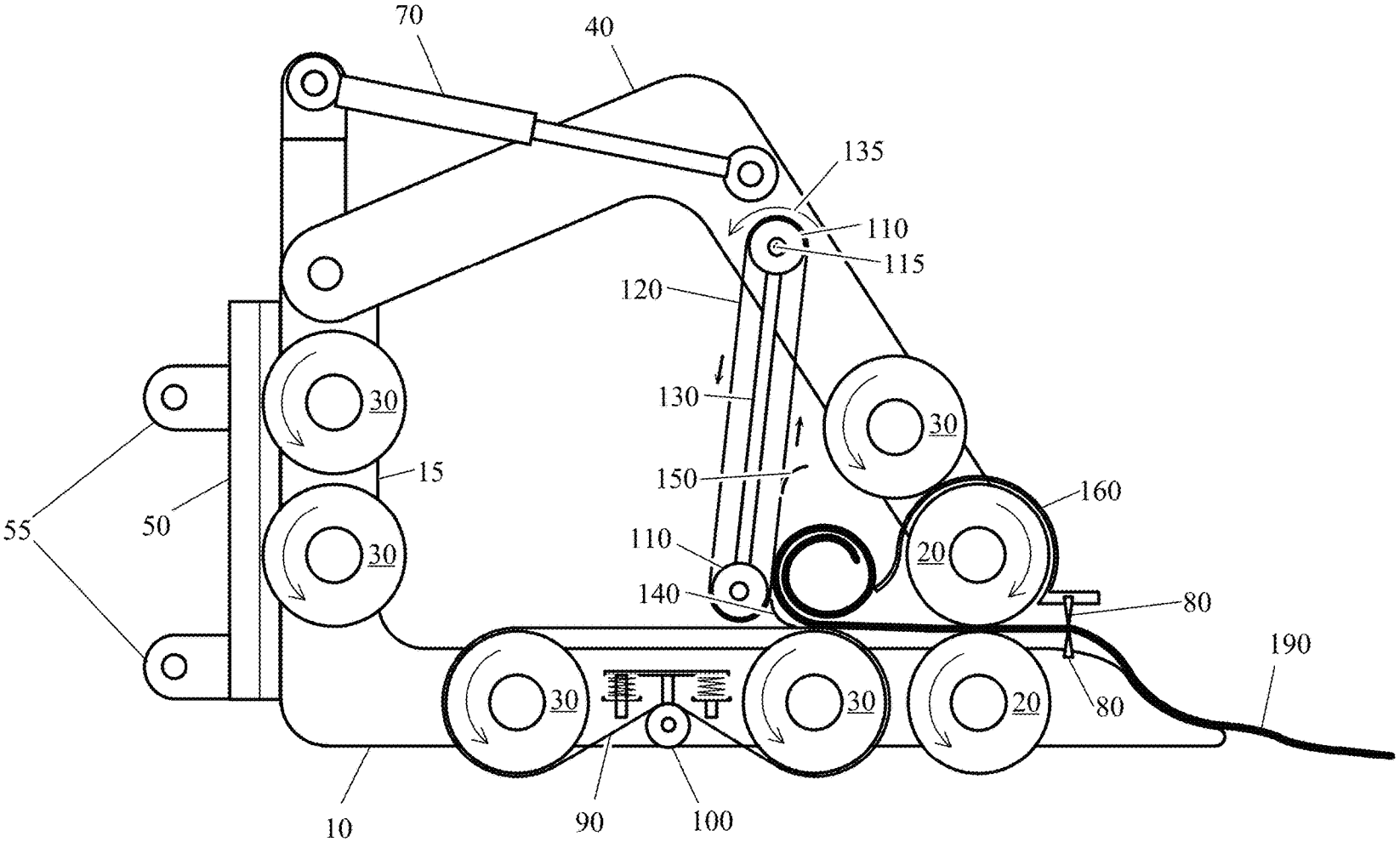
FIG. 7 shows a side view of the geotextile rolling and collection apparatus of FIG. 1 having accumulated a small geotextile roll.
Figure 8:
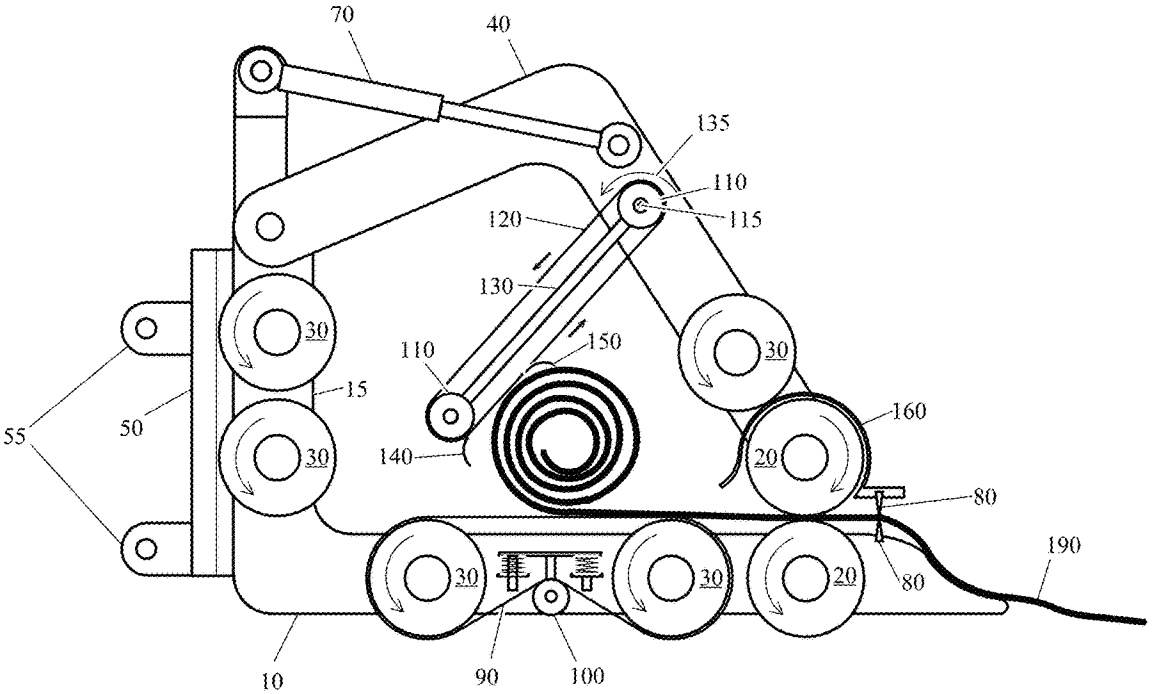
FIG. 8 shows a side view of the geotextile rolling and collection apparatus of FIG. 1 having accumulated a geotextile roll large enough to partially displace the curl belt and curl belt frame.

As shown in FIG. 7 and FIG. 8, continual feeding of the geotextile liner 190 into the geotextile rolling and collecting apparatus forms a roll of geotextile liner 190 within the space defined between the upper forks 40 and lower forks 10 when the upper forks 40 and lower forks 10 are in a collect position. Rotation of the roller drums 30 of the upper forks 40 and lower forks 10 and movement of the curl belt 120 imparts a continuous rolling motion to the geotextile roll as geotextile liner 190 is pulled into the geotextile rolling and collecting apparatus by the counter-rotating feed drums 20. As the geotextile roll increases in diameter, the curl belt frame 130 and curl belt 120 rotate to the rear and upwardly, against the spring bias 135 at the curl belt axle 115 of the curl belt frame 130. The spring bias 135 at the curl belt axle 115 maintains the curl belt 120 in contact with the geotextile roll with sufficient force to assist with the rolling process.

Figure 9:
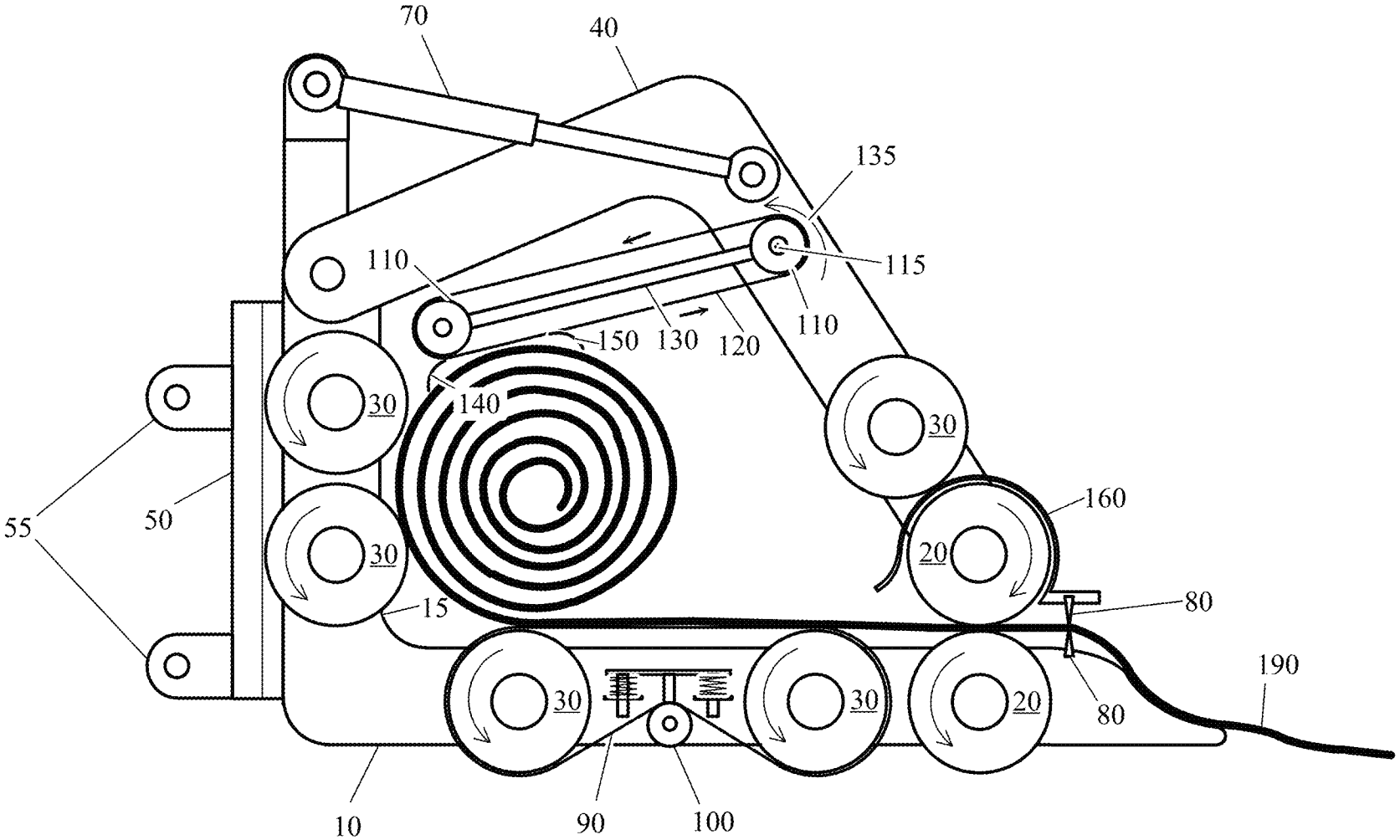
FIG. 9 shows a side view of the geotextile rolling and collection apparatus of FIG. 1 having accumulated a geotextile roll large enough to completely displace the curl belt and curl belt frame and be rolled by rear roller drums.

Referring now to FIG. 9, when the size and weight of the geotextile roll are sufficient to overcome the spring bias 135 of the curl belt frame 130, the curl belt 120 and curl belt frame 130 are deflected rearward and upward, rotating on the curl belt axle 115. The geotextile roll may move to the rear of the geotextile rolling and collecting apparatus, where additional roller drums 30 on the vertical elements 15 of the lower forks 10 further drive the rotation of the geotextile roll as the geotextile liner 190 continues to feed into the geotextile rolling and collecting apparatus.

As shown in FIG. 10, when the geotextile roll has reached a predetermined diameter in size, or the geotextile liner 190 has been completely fed into the geotextile rolling and collecting apparatus, linear actuators 70 raise the upper forks 40 so that the geotextile roll can be removed from the geotextile rolling and collecting apparatus. A fork lift, a front end loader with a lance attachment, may be used to remove the geotextile roll from the geotextile rolling and collecting apparatus. Alternatively, the lifting arms of the prime mover carrying the geotextile rolling and collecting apparatus may be tilted forward to allow the geotextile roll to roll out of the front of the geotextile rolling and collecting apparatus and onto the ground, a flatbed truck, or stack of geotextile rolls.

Figure 12:
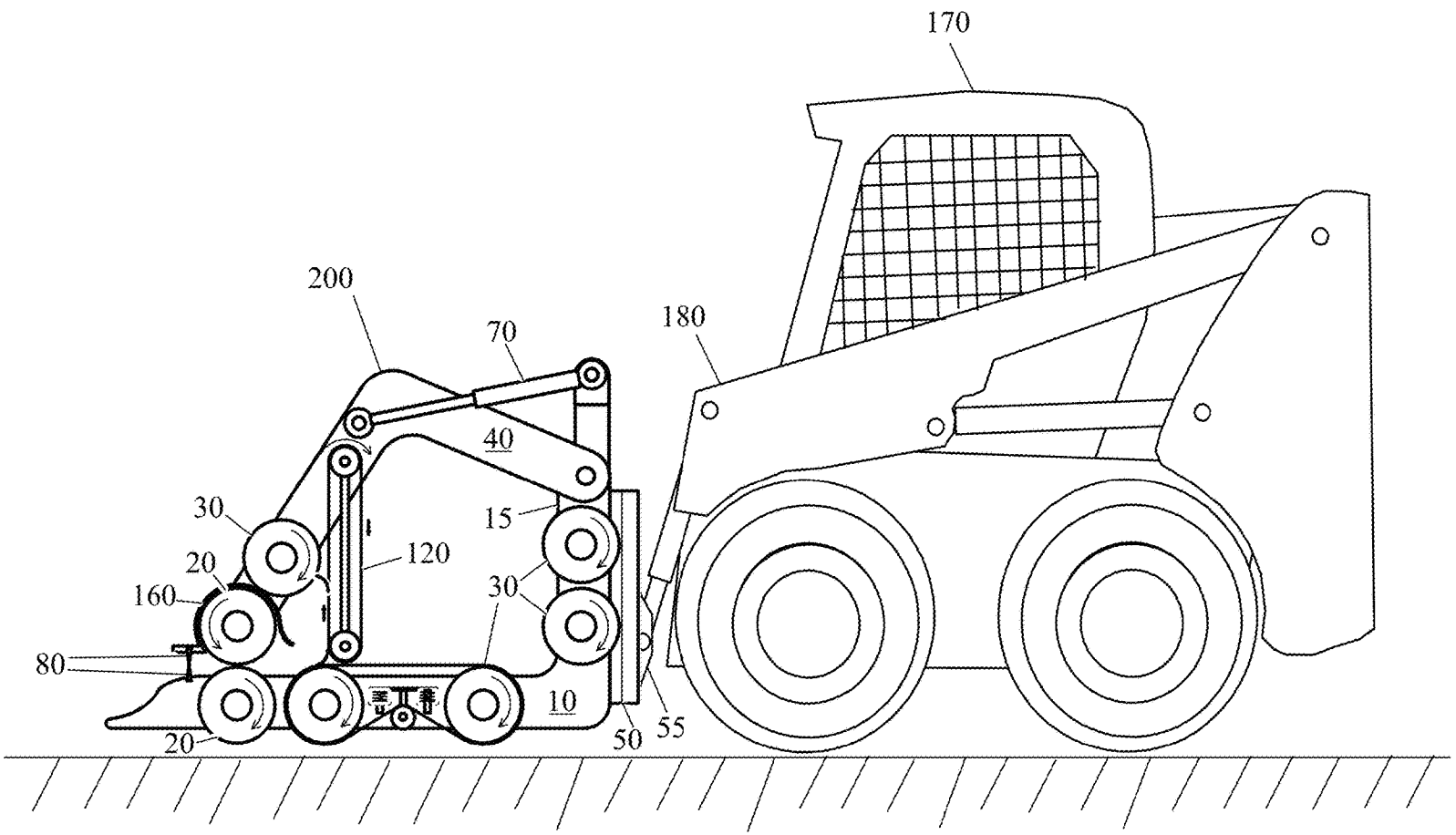
FIG. 12 shows a side view of the geotextile rolling and collection apparatus of FIG. 1 in an operational configuration attached to a skid steer.

FIG. 12 shows the geotextile rolling and collection apparatus 200 attached to the lift arms 180 of a skid steer 170 by way of the mounts 55.

While the geotextile rolling and collecting apparatus has been discussed herein primarily in relation to strips of heavy gauge polymer geotextile liner, the applications of the device are not limited by the material to be rolled. Any material capable of being rolled may be collected with the apparatus, including but not limited to, geotextile strips, artificial turf strips, carpeting, and roofing membranes.

In some embodiments, the geotextile rolling and collecting apparatus includes a reciprocating carrier on one or more rollers to apply a wrap around a geotextile roll in the collecting volume prior to expelling the geotextile roll. The wrap prevents the geotextile roll from unrolling after being expelled from the geotextile rolling and collecting apparatus. In some embodiments, the wrap also protects the geotextile roll from damage or detritus during storage or transport of the geotextile roll. In some embodiments, the wrap is stretch wrap. In some embodiments, the reciprocating carrier moves a roll of stretch wrap from side to side as the finished geotextile roll continues to be circulated in the collecting volume, thereby wrapping the geotextile roll in the stretch wrap. In some embodiments, the wrap includes an adhesive.

In some embodiments, a cutter is used in combination with the geotextile rolling and collecting apparatus to cut the geotextile liner into two or more strips having a width within a predetermined range of widths less than or about equal to the width of the geotextile rolling and collecting apparatus. In some embodiments, the cutter is part of a cutting apparatus that is a separate apparatus from the geotextile rolling and collecting apparatus. In other embodiments, the cutter is an integrated part of the geotextile rolling and collecting apparatus, preferably extending from one of the lower forks.

Figure 13:
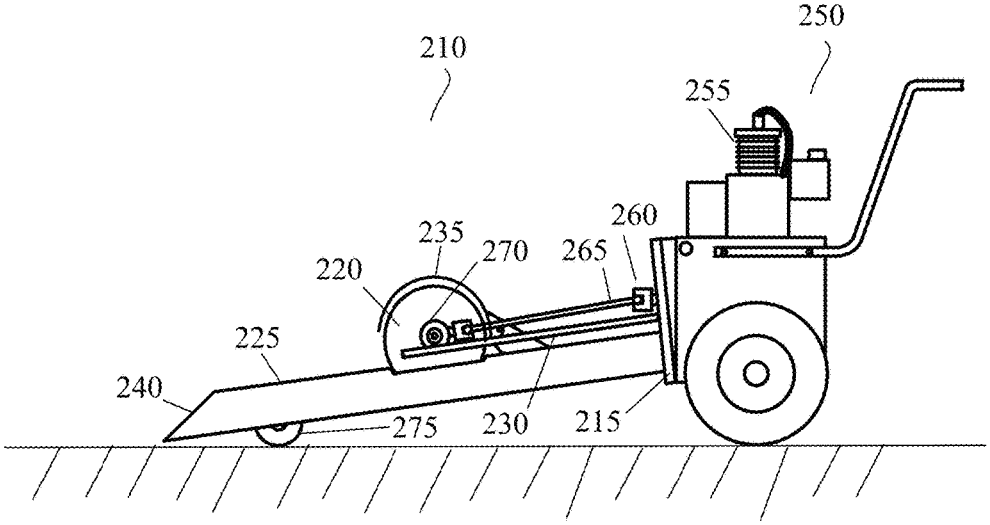
FIG. 13 shows a side view of a cutter with a self-propelled walk-behind carriage.

FIG. 13 shows a cutter 210 mated to a self-propelled carriage 250 having two drive wheels and a front power take off, as is commonly used in snow blowers, roto-tillers, and other small scale landscaping and home maintenance equipment. The mounting plate 215 has been appropriately sized and provided with mounting points for this purpose. The self-propelled carriage 250 is preferably powered by a gasoline engine 255, but is also capable of being powered by an electric motor. A universal joint 260 powered by the self-propelled carriage 250 mates with a drive shaft 265 that in turn provides power to a right angle transmission 270 to which the cutting disk 220 is attached.

The lifting arm 225 extends from the mounting plate 215 and provides structural support for the cutting disc 220, universal joint 260, and transmission. The leading end of the lifting arm 225 is formed with a bevel 240 that allows the lifting arm 225 to easily wedge between the material to be cut and underlying surfaces, so as to lift the material to be cut off the underlying surface and guide it along the lifting arm 225 to the cutting disk 220. One end of a service boom 230 is welded to the mounting plate 215 parallel to, and slightly above, the top of the lifting arm 225. A blade guard 235 is employed to prevent injury from personnel coming in contact with the cutting disk 220, or from debris propelled by the cutting disk 220. Additionally, a height adjustable wheel 275 is added under the lifting arm 225 to provide stability and to ensure that the bevel 240 of the lifting arm is optimally positioned to slide under the material to be lifted, but does not dig into potentially sensitive underlayment, such as fiberboard or plywood found under large area carpeting, or roofing membranes, for example.

Although the cutter in FIG. 13 is shown attached to a self-propelled carriage, the cutter may alternatively be attached to one of the two outer lower forks of the geotextile rolling and collecting apparatus. In such embodiments, the mounting plate 215 is adapted to couple to the outer lower fork of the geotextile rolling and collecting apparatus. Although cutters may be located on each of the two outer lower forks, the geotextile rolling and collecting apparatus preferably operates along an edge of the geotextile liner such that only one edge of the geotextile liner needs to be cut. The geotextile rolling and collecting apparatus preferably has only one cutter attached to one of the two outer lower forks.

Figure 14:
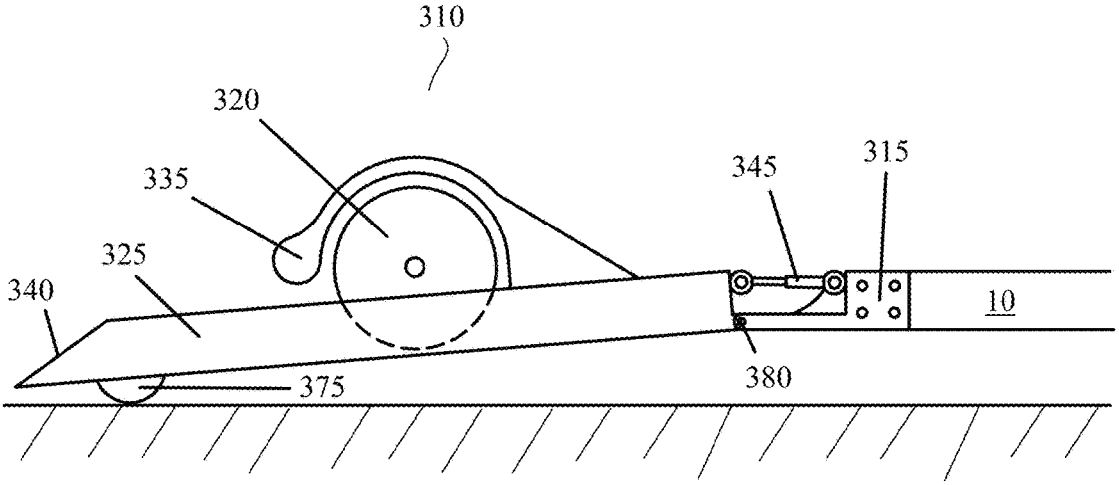
FIG. 14 shows a side view of a cutter attached to a lower fork of the geotextile rolling and collection apparatus of FIG. 1.

FIG. 14 shows a cutter 310 attached to an outer lower fork 10 of a geotextile rolling and collecting apparatus, such as the geotextile rolling and collecting apparatus of FIG. 1, by way of a mounting plate 315. The cutter 310 includes a linear actuator 345 pushing the lifting arm 325 to rotate around a pivot point 380, thereby biasing the bevel 340 downward toward the ground. The cutter 310 is only shown schematically in FIG. 14 with only the cutting disc 320, blade guard 335, and height-adjustable wheel 375 also being shown. The cutter 310 of FIG. 14 preferably also includes the additional structures shown for the cutter 210 of FIG. 13.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A geotextile rolling and collecting apparatus comprising:

a mounting plate having a front side and a back side opposite the front side;

a pair of outer lower forks arranged laterally, each outer lower fork being substantially L-shaped and comprising a vertical section extending vertically upward from a horizontal section and attached to the front side of the mounting plate;

a pair of outer upper forks, each outer upper fork being substantially L-shaped and having a first end pivotally attached to the vertical section of one of the pair of outer lower forks and having a second end opposite the first end;

at least one linear actuator coupled to rotate the outer upper forks with respect to the outer lower forks between a collecting position and an open position;

at least one lower feed drum mounted on a first horizontal axis between horizontal sections of the pair of outer lower forks;

at least one upper feed drum mounted on a second horizontal axis between the second ends of the pair of outer upper forks; and at least one first drive motor coupled to rotate the lower feed drum on the first horizontal axis and to counter-rotate the upper feed drum on the second horizontal axis;

wherein when the geotextile rolling and collecting apparatus is in the collecting position, a geotextile liner grasped between the upper feed drum and the lower feed drum is fed by counter-rotation of the upper feed drum and the lower feed drum into a collecting volume behind the upper feed drum and the lower feed drum and between the upper forks and the lower forks to form at least one geotextile liner roll in the collecting volume.

2. The geotextile rolling and collecting apparatus of claim 1 further comprising:

at least one inner lower fork located between the pair of outer lower forks, the inner lower fork being substantially L-shaped and comprising a vertical section extending vertically upward from a horizontal section and attached to the front side of the mounting plate; and at least one inner upper fork located between the pair of outer upper forks, the inner upper fork being substantially L-shaped and having a first end pivotally attached to the vertical section the inner lower fork and having a second end opposite the first end;

wherein the at least one lower feed drum comprises at least two lower feed drums and the at least one upper feed drum comprises at least two upper feed drums, each lower feed drum being located between lower forks and each upper feed drum being located between upper forks.

3. The geotextile rolling and collecting apparatus of claim 1 further comprising at least one roller drum mounted between the horizontal sections of the outer lower forks to rotate on a third horizontal axis in the same direction as the lower feed drum to rotate the geotextile liner to form the geotextile liner roll.

4. The geotextile rolling and collecting apparatus of claim 1 further comprising at least one roller drum mounted between the vertical sections of the outer lower forks to rotate on a third horizontal axis in the same direction as the lower feed drum to rotate the geotextile liner to form the geotextile liner roll.

5. The geotextile rolling and collecting apparatus of claim 1 further comprising at least one roller drum mounted between the outer upper forks above the upper feed drums to rotate on a third horizontal axis in the same direction as the lower feed drum to rotate the geotextile liner to form the geotextile liner roll.

6. The geotextile rolling and collecting apparatus of claim 1 further comprising:

a curl belt frame pivotally mounted on a curl belt axle at a first end of the curl belt frame to at least one of the pair of outer upper forks and biased at the curl belt axle in the same direction as the direction of rotation of the lower feed drum; and a curl belt rotatable around a first curl belt drum at the first end of the curl belt frame and a second curl belt drum at a second end of the curl belt frame opposite the first end;

wherein the curl belt is driven by at least one of the curl belt drums to rotate in the same direction as the lower feed drum to rotate the geotextile liner to form the geotextile liner roll.

7. The geotextile rolling and collecting apparatus of claim 6 further comprising a lower shroud at the second end of the curl belt frame guiding the geotextile liner toward the curl belt.

8. The geotextile rolling and collecting apparatus of claim 6 further comprising an upper shroud between the first end and the second end of the curl belt frame guiding the geotextile liner off the curl belt.

9. The geotextile rolling and collecting apparatus of claim 1 further comprising an upper wiper blade extending downward from the upper fork in front of the lower feed drum and a lower wiper blade extending upward from the lower fork in front of the lower feed drum to contact an upper surface and a lower surface of the geotextile liner being fed into the geotextile rolling and collecting apparatus.

10. The geotextile rolling and collecting apparatus of claim 1 further comprising a feed shroud extending above and behind the upper feed drum to prevent the geotextile liner roll from contacting the upper feed drum.

11. The geotextile rolling and collecting apparatus of claim 1 further comprising:

a first roller drum mounted between the horizontal sections of the outer lower forks and a second roller drum mounted between the horizontal sections of the outer lower forks and between the first roller drum and the lower feed drum; and a drive belt around the first roller drum and the second roller drum to drive the first roller drum and the second roller drum to rotate in the same direction as the lower feed drum.

12. The geotextile rolling and collecting apparatus of claim 1 further comprising:

at least two mounts extending from the back side of the mounting plate; and a prime mover having at least two lifting arms, wherein the mounts removably couple the mounting plate to the lifting arms of the prime mover.

13. A method of collecting a geotextile liner located on a ground surface as at least one geotextile liner roll, the method comprising the steps of:

a) placing a leading edge of the geotextile liner between at least one upper feed drum and at least one lower feed drum of a geotextile rolling and collecting apparatus in a collecting position, the geotextile rolling and collecting apparatus comprising:

a mounting plate having a front side and a back side opposite the front side;

a pair of outer lower forks arranged laterally, each outer lower fork being substantially L-shaped and comprising a vertical section extending vertically upward from a horizontal section and attached to the front side of the mounting plate;

a pair of outer upper forks, each outer upper fork being substantially L-shaped and having a first end pivotally attached to the vertical section of one of the pair of outer lower forks and having a second end opposite the first end;

at least one linear actuator coupled to rotate the outer upper forks with respect to the outer lower forks between the collecting position and an open position;

the at least one lower feed drum mounted on a first horizontal axis between horizontal sections of the pair of outer lower forks;

the at least one upper feed drum mounted on a second horizontal axis between the second ends of the pair of outer upper forks; and at least one first drive motor coupled to rotate the lower feed drum on the first horizontal axis and to counter-rotate the upper feed drum on the second horizontal axis;

b) feeding the geotextile liner grasped between the upper feed drum and the lower feed drum by counter-rotation of the upper feed drum and the lower feed drum into a collecting volume behind the upper feed drum and the lower feed drum and between the upper forks and the lower forks; and c) rotating the geotextile liner in a predetermined direction within the collecting volume as the geotextile liner is fed to the collecting volume to form the geotextile liner roll in the collecting volume.

14. The method of claim 13, wherein step c) comprises the sub-step of:

rotating the geotextile liner in the predetermined direction using at least one roller drum mounted between the horizontal sections of the outer lower forks to rotate on a third horizontal axis in the same direction as the lower feed drum.

15. The method of claim 13, wherein step c) comprises the sub-step of:

rotating the geotextile liner in the predetermined direction using at least one roller drum mounted between the vertical sections of the outer lower forks to rotate on a third horizontal axis in the same direction as the lower feed drum.

16. The method of claim 13, wherein step c) comprises the sub-step of:

rotating the geotextile liner in the predetermined direction using at least one roller drum mounted between the outer upper forks above the upper feed drums to rotate on a third horizontal axis in the same direction as the lower feed drum.

17. The method of claim 13, wherein step c) comprises the sub-step of:

rotating the geotextile liner in the predetermined direction using a curl belt, the geotextile rolling and collecting apparatus further comprising:

a curl belt frame pivotally mounted on a curl belt axle at a first end of the curl belt frame to at least one of the pair of outer upper forks and biased at the curl belt axle in the same direction as the direction of rotation of the lower feed drum; and the curl belt rotatable around a first curl belt drum at the first end of the curl belt frame and a second curl belt drum at a second end of the curl belt frame opposite the first end; and wherein the curl belt is driven by at least one of the curl belt drums to rotate in the same direction as the lower feed drum.

18. The method of claim 13 further comprising actuating the linear actuator to rotate the outer upper forks with respect to the outer lower forks to the open position and expelling the geotextile liner roll from the geotextile rolling and collecting apparatus.

19. The method of claim 13 further comprising actuating the linear actuator to rotate the outer upper forks with respect to the outer lower forks to the open position and expelling the geotextile liner roll from the geotextile rolling and collecting apparatus.

* * * * *